US010730672B2

(12) United States Patent
Bertram et al.

(10) Patent No.: US 10,730,672 B2
(45) Date of Patent: Aug. 4, 2020

(54) CONTAINER AND LID WITH AUDIBLE AND TACTILE FEEDBACK

(71) Applicant: Conopco, Inc., Englewood Cliffs, NJ (US)

(72) Inventors: James Alexander Bertram, Bristol (GB); James Robert Coop, Bristol (GB); Arie Johannes van Puffelen, Vlaardingen (NL); Mark Digby Teucher, Bath (GB); Omer Bin Younos, Vlaardingen (NL)

(73) Assignee: Conopco Inc., Englewood Cliffs, NJ (US)

( * ) Notice: Subject to any disclaimer, the term of this patent is extended or adjusted under 35 U.S.C. 154(b) by 0 days.

(21) Appl. No.: 16/086,355

(22) PCT Filed: Mar. 20, 2017

(86) PCT No.: PCT/EP2017/056510
§ 371 (c)(1),
(2) Date: Sep. 19, 2018

(87) PCT Pub. No.: WO2017/162559
PCT Pub. Date: Sep. 28, 2017

(65) Prior Publication Data

US 2019/0119015 A1 Apr. 25, 2019

(30) Foreign Application Priority Data

Mar. 25, 2016 (EP) ..... 16162470

(51) Int. Cl.
*B65D 51/24* (2006.01)
*B65D 43/02* (2006.01)

(52) U.S. Cl.
CPC ..... *B65D 51/248* (2013.01); *B65D 43/0231* (2013.01); *B65D 2251/01* (2013.01);
(Continued)

(58) Field of Classification Search
CPC .... B65D 2251/01; B65D 41/17; B65D 41/16; B65D 21/0228; B65D 41/165
See application file for complete search history.

(56) References Cited

U.S. PATENT DOCUMENTS 4,494,665 A 1/1985 Lehmann
4,682,700 A * 7/1987 Montgomery ..... B65D 41/0471 215/216

(Continued)

FOREIGN PATENT DOCUMENTS

DE 9317231 U1 2/1994
DK 9317231 2/1994

(Continued)

OTHER PUBLICATIONS

IPRP2 in PCTEP2017056510; dated Jul. 16, 2018.

(Continued)

*Primary Examiner* — Shawn M Braden
(74) *Attorney, Agent, or Firm* — N.V. Nederlandsch Octrooibureau; Catherine A. Shultz; Tamara C. Stegmann

(57) ABSTRACT

The present invention relates to a container (10) and a lid (12) for food products, wherein the lid produces audible and tactile feedback when the container is closed with the lid. The invention further relates to a method for forming a lid for engagement with a container for food products. According to a first aspect of the invention, a container with a lid comprises a body with a neck (14) surrounding an opening; at least one thread (20) on the neck; at least one thread (16) on the lid for engaging the at least one thread on the neck; and an engagement mechanism (18) on the lid to secure the lid to the body when the lid is in a fully engaged position. Audible and tactile feedback are produced when the lid moves into the fully engaged position.

8 Claims, 4 Drawing Sheets

(52) U.S. Cl.
CPC ..... *B65D 2543/0074* (2013.01); *B65D 2543/00092* (2013.01); *B65D 2543/00296* (2013.01); *B65D 2543/00527* (2013.01); *B65D 2543/00537* (2013.01); *B65D 2543/00805* (2013.01)

(56) References Cited

U.S. PATENT DOCUMENTS

| | | | | |
|---|---|---|---|---|
| 5,439,103 | A * | 8/1995 | Howes ..... | B65D 5/4291 206/217 |
| 5,462,186 | A | 10/1995 | Ladina et al. | |
| 5,762,218 | A | 9/1998 | Sachau | |
| 6,041,953 | A | 3/2000 | Goodall | |
| 6,123,212 | A | 9/2000 | Russell et al. | |
| 8,245,860 | B2 | 8/2012 | Farrar et al. | |
| 2008/0110850 | A1 | 5/2008 | Tilton | |
| 2013/0180942 | A1 | 7/2013 | Bardet | |

FOREIGN PATENT DOCUMENTS

| | | |
|---|---|---|
| EP | 251259 | 1/1988 |
| EP | 0251259 A1 | 1/1988 |
| EP | 2080711 | 7/2009 |
| RU | 2388672 | 5/2010 |

OTHER PUBLICATIONS

Written Opinion in PCTEP2017056510; dated Feb. 13, 2018.
Search Report & Written Opinion in PCTEP2017056510.
Search Report and Written Opinion in EP16162470.

* cited by examiner

CONTAINER AND LID WITH AUDIBLE AND TACTILE FEEDBACK

FIELD OF THE INVENTION

The present invention relates to a container and a lid, wherein the lid produces audible and tactile feedback when the container is closed with the lid. The invention further relates to a method for forming a lid for engagement with a container.

BACKGROUND OF THE INVENTION

Containers with lids which fit together with threads come in many different arrangements, from simply having complementary threads to having different closing and/or locking features or arrangements. Some provide notches, locks, snaps and/or protrusions to secure the container to the lid. Additionally, these can sometime provide a click or other sound to help the user know when the lid is sufficiently secured to or unsecured from the container.

One such container with lid is shown in US 2008/0110850 A1. This container and lid secure together with threads, and the lid and the container include a complementary notch and lug to provide an audible indication the lid is sufficiently closed. These notches and lugs are located in a central position of the threads, separating the threads into segments.

U.S. Pat. No. 6,041,953 shows a number of different containers and closures which are aimed at having a closure which effectively seals plastics material after manufacture and filling. Many of the closures disclosed include a slot in the neck of the container for receiving a flange on the closure, with threads to mate the container and closure together. One embodiment includes a collar formed on the surface of the container, which the bottom edge of the closure abuts to isolate the threads from contact with water or another fluid in which the container may be immersed.

EP 0 251 259 A1 relates to a screw cap made of plastic for containers, particularly bottles.

US 2008/110850 A1 relates to an audible closing feature for threaded containers and lids.

Another such container is disclosed in EP 2 080 711 A1, which provides a container for a fabric conditioning composition where the lid produces an audible sound by manually forced interengagement of the locking members. The closure is stated that it can be a push-on-push-off lid and could include threads with the interengageable locking members, which preferably would be an outward projection on an outer surface of the dispensing opening and a corresponding inwardly oriented recess on an inner surface of the lid. These can provide audible and tactile feedback to the users.

SUMMARY OF THE INVENTION

Nevertheless there is a need for another type of container and lid for food products, wherein the lid produces audible and tactile feedback when the container is closed with the lid. The present invention provides such another type of container and lid.

According to a first aspect of the invention, a container with a lid for food products comprises a body with a neck surrounding an opening; at least one thread on the neck; an annular ring on the neck beneath the at least one thread; at least one thread on the lid for engaging the at least one thread on the neck; and an engagement mechanism on the lid to engage the annular ring and secure the lid to the neck when the lid is in a fully engaged position. Audible and tactile feedback are produced when the lid moves into the fully engaged position. The annular ring projects radially outward from the neck on an outer circumference of the neck, and can extend further than the at least one thread on the neck.

In a second aspect the present invention provides a method of forming a lid for engagement with a container with an annular ring, the method comprising forming a lid with at least one thread; and forming an engagement mechanism on a lower portion of an inner surface of the lid positioned such that audible and tactile feedback are produced from the engagement of the engagement mechanism and the annular ring when the lid has moved into a fully engaged position with the container.

Such a container with a lid with an engagement mechanism which can engage the annular ring helps to both secure the lid to the neck of the container, and to provide the user with audible and tactile feedback to know such full engagement has taken place. The sensorial feedback helps the user to ensure full engagement every time, which is especially useful when container holds things are prone to spoilage if not properly sealed between uses, for example, food products. The engagement of the annular ring on the neck allows for use with a variety of containers that typically already have an annular neck, for example, for neck handling purposes during manufacturing or other operations. The lid can engage with a standard container neck to provide the desired engagement and sensorial feedback from engagement (and disengagement).

According to an embodiment, the engagement mechanism comprises a protrusion at a lower portion of the lid positioned to snap over the annular ring to bring the lid into the fully engaged position. The protrusion acts as the engagement mechanism snapping over the annular ring to engage or snapping off the annular ring when disengaging the lid from the container to produce the audible and tactile feedback. The protrusion can be shaped and/or sized to provide the specific range of desired audible and tactile feedback according to container and lid materials, shape, etc.

According to an embodiment, the lid further comprises a recess to receive the annular ring. This recess can form a whole or part of the engagement mechanism, receiving the annular ring when the lid is sufficiently engaged to the container, and providing the audible and/or tactile feedback desired.

According to an embodiment, the audible and/or tactile feedback is generated by the engagement mechanism moving over the annular ring to engage the lid with or disengage the lid from the neck. The movement over the annular ring typically flexes the engagement mechanism and/or the lid. Once over the annular ring, the lid and/or engagement mechanism resume the natural state. The interactions and/or flexing can produce the audible and/or tactile feedback.

According to an embodiment, a subtle pop is generated upon disengaging the lid from the container. The subtle pop lasts about 0.01 seconds or more upon disengaging the lid from the container. Alternatively, this subtle pop can last anywhere in the range of about 0.002 seconds to about 0.025 seconds, preferably to about 0.02 seconds. Further optionally, the subtle pop has a sound pressure level in the range of about 20 to 120 dB, preferably 30 to 100 dB, preferably 35 to 80 dB, preferably maximally 70 dB. Further optionally, the frequency intensity of the subtle pop is in the range of about 0.00005 to 0.002 watt per square metre ($W/m^2$), preferably from about 0.00005 to 0.001 $W/m^2$, preferably from about 0.0001 to 0.0008 $W/m^2$. The subtle pop can give a user surety that the lid was fully and properly engaged to the container neck, thereby assuring the user of the freshness of the contents of the container. This can also allow the user to feel the disengagement process. These specific duration and frequency intensity ranges have been shown to be reassuring for test users.

The sound levels referenced for the audible feedback are generally from a distance of about 0.5 meters, or an arm's length.

According to an embodiment, the engagement mechanism comprises a plurality of extended protrusions at a lower portion of the lid positioned to snap over the annular ring when the lid moves into the fully engaged position. The plurality of extended protrusions can assure a secure engagement of the lid to the container. Additionally, the space between the extended protrusions can allow for relatively easier engagement of protrusions to annular ring in the process of engaging the lid with the container.

According to an embodiment, at least one thread on the neck and/or the at least one thread on the lid are varied in thickness such that progressive torque is required to bring the lid to the fully engaged position. Such a feature can provide further tactile feedback for a user when engaging or disengaging the lid to or from the container. The increasing torque on engagement also helps to ramp up to the torque required for engagement of the engagement mechanism to the annular ring. Thus, the user can gradually increase or decrease torque when engaging or disengaging lid.

According to an embodiment, full engagement of the lid with the neck produces a snap sound. Optionally, the snap sound lasts about 0.01 seconds or more. Preferably this is in the range of about 0.01 seconds to about 0.025 seconds, preferably to about 0.02 seconds. Preferably the snap sound has a sound pressure level in the range of about 20 to 120 dB, preferably 30 to 100 dB, preferably 35 to 80 dB, preferably maximally 70 dB. Preferably the frequency intensity of the snap is in the range of about 0.00005 to 0.003 watt per square metre ($W/m^2$), preferably from about 0.00005 to 0.002 $W/m^2$, preferably from about 0.0001 to 0.0016 $W/m^2$. Producing a snap sound at full engagement helps a user to know when the lid has been fully engaged to the container to seal the contents inside. This also helps to prevent a user trying to turn the lid more with respect to the container even after full engagement, which can damage threads and/or the seal between the lid and container. The duration and frequency intensity ranges have been found to demonstrate a unique sound profile and frequency histogram, which the user will learn to associate with knowledge that there has been proper engagement between the lid and the container.

According to a further aspect of the invention, a method of forming a lid for engagement with a container with an annular ring comprises forming a lid with at least one thread; and forming an engagement mechanism on a lower portion of an inner surface of the lid positioned such that audible and tactile feedback are produced from the engagement of the engagement mechanism and the annular ring when the lid has moved into a fully engaged position with the container.

Such a lid can work with a variety of standard containers which include an annular neck ring to provide a simple method for ensuring they are properly engaged and providing a user audible and tactile feedback such that the user knows this as well. The audible and tactile feedback provided by the engagement mechanism engaging the annular ring allows the user to know when the lid is fully engaged or becoming disengaged.

According to an embodiment, the step of forming an engagement mechanism on a lower portion of an inner surface of the lid comprises forming at least one protrusion for engaging the annular ring when the lid has been moved into a fully engaged position with the container. The at least one protrusion can be formed to snap over the annular ring when the lid is fully engaged, and provide an audible and tactile sound when doing so to let the user know that the lid is fully engaged. Similarly, the disengagement of the protrusion and the annular ring (by the protrusion moving back over the annular ring) provides audible and tactile feedback.

According to an embodiment, the step of forming at least one protrusion for engaging the annular ring when the lid has been moved into a fully engaged position with the container comprises forming a plurality of extended protrusions for engaging the annular ring when the lid has been moved into a fully engaged position with the container. A plurality of extended protrusions can provide more engagement surfaces for engaging with the annular ring.

According to an embodiment, the step of forming an engagement mechanism on a lower portion of an inner surface of the lid comprises forming a recess for receiving the annular ring when the lid has been moved into a fully engaged position with the container. The recess can be used in combination with the protrusions or separately, and can provide audible and/or tactile feedback when receiving the annular ring for engagement.

DETAILED DESCRIPTION OF THE INVENTION

Figure 1A:
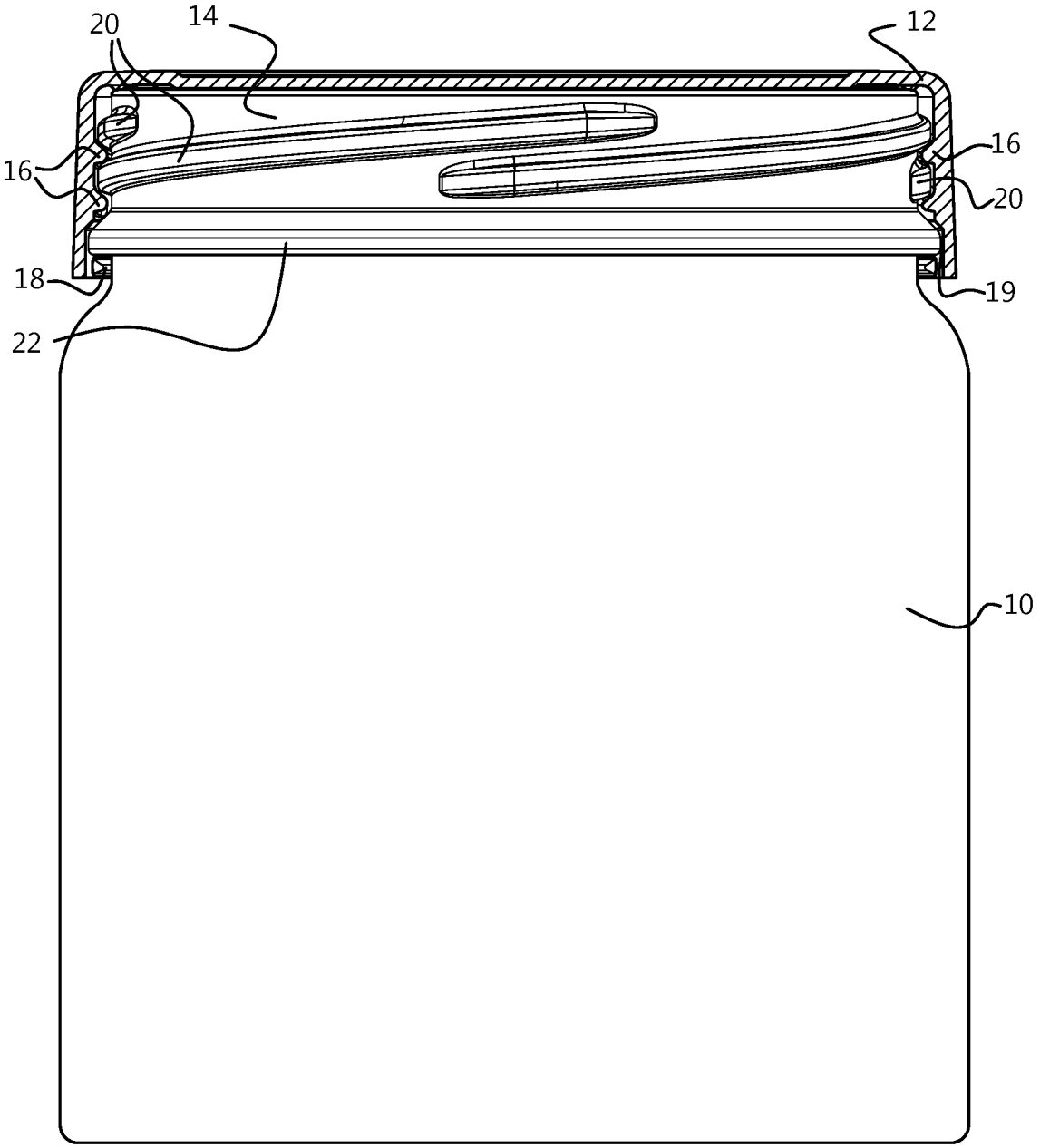
FIG. 1A illustrates a view of a container and a lid, with the lid shown in cross-section.
Figure 1B:
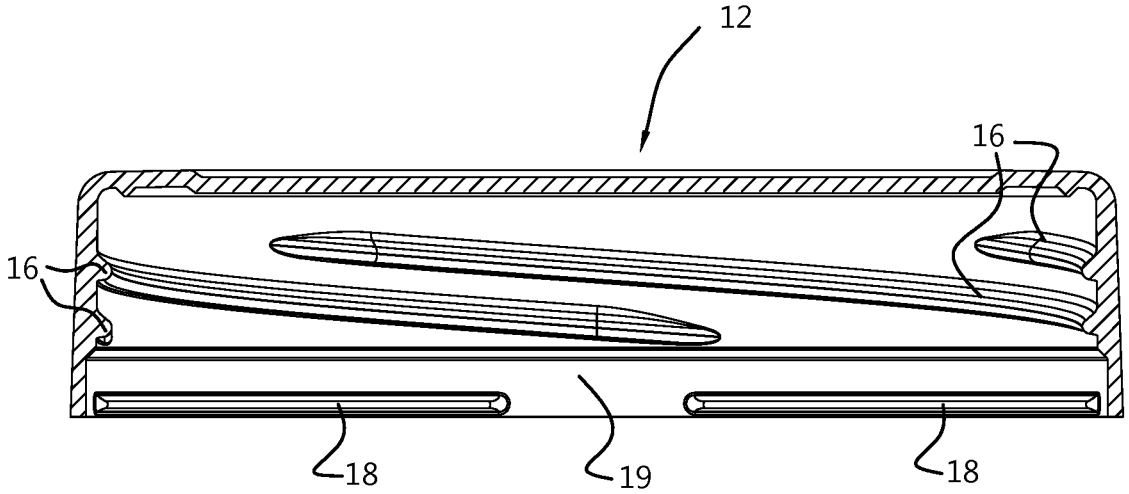
FIG. 1B illustrates a cross-sectional view of a lid.
Figure 1C:
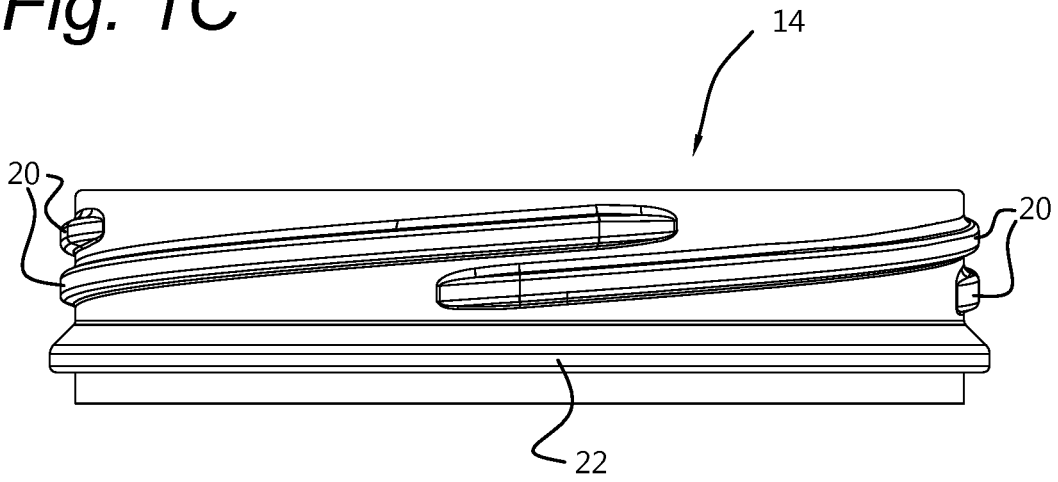
FIG. 1C illustrates a side view of a container neck.

FIG. 1A illustrates a view of a container 10 and lid 12, with lid 12 shown in cross-section, FIG. 1B illustrates a cross-sectional view of lid 12 and FIG. 1C illustrates a side view of container 10 neck 14. Container 10 can be any type of container, but may be particularly useful for the storage of food products, and especially products which are opened and closed a number of times during lifetime use.

Lid 12 includes threads 16 and an engagement mechanism which includes protrusions 18 and recess 19. Lid 12 is generally cylindrical in shape on the outer side, and can be formed of a variety of materials. The lid preferably comprises polypropylene or high density polyethylene. In this embodiment, lid 12 includes two threads 16 wrapping around the inner surface of lid, but other embodiments could have more or fewer threads. Protrusions 18 are located around the inner surface at a lower end of lid 12, and recess 19 is positioned just above protrusions 18. In this embodiment lid 12 includes four extended protrusions 18, though other embodiments could have more or fewer, including one extended protrusion around the entire inner side of lid 12.

Neck 14 of container 10 includes threads 20 and annular ring 22. Threads 20 expand in thickness from the upper end of neck 14 toward the lower end of neck 14. Annular ring 22 extends all the way around an outer circumference of neck 14 at a lower portion of neck 14. Container 10 and neck 14 can be formed as one piece, preferably comprising polyethylene terephthalate.

As can be seen in FIG. 1A, lid 12 rotates to engage neck 14 such that threads 16 on lid 12 engage threads 20 on neck 14 to secure lid 12 to container 10. Engagement mechanisms are positioned such that protrusions 18 engage annular ring 22, which fits into recess 19 when lid 12 is fully engaged with neck 14 of container. Due to the increase in thickness of threads 20 from an upper part of neck 14 to a lower part, the torque required to fully engage lid 12 to neck 14 increases as it comes closer to full engagement. This helps to gradually ramp up to the torque required to bring protrusions 18 over annular ring 22. The torque range can be, for example, 0.5 to 8 N·m.

When protrusions 18 move over annular ring 22 to engage annular ring 22 in recess 19, a snap sound and tactile feedback is generated for the user. The tactile feedback is also generated in the increase in thickness of threads. Such a snap can last about 0.01 seconds, preferably this is in the range of about 0.01 seconds to about 0.025 seconds, preferably to about 0.02 seconds. Preferably the frequency intensity of the snap is in the range of about 0.00005 to 0.003 watt per square metre ($W/m^2$), preferably from about 0.00005 to 0.002 $W/m^2$, preferably from about 0.0001 to 0.0016 $W/m^2$ (see FIG. 2). These ranges for length and frequency of the audible feedback of full engagement follow a unique profile and are shown to be re-assuring for users. The specific ranges can vary depending on materials used, thickness of annular ring, profile/design of annular ring, material distribution, contents of container 10, configuration of neck 14 and lid 12, etc.

When it is desired to remove lid 12 from neck 14, protrusions 18 must be disengaged from annular ring 22, which generates a subtle pop sound as well as tactile feedback for the user. This sound can last about 0.01 seconds or more, preferably maximally about 0.025 seconds, preferably maximally to about 0.02 seconds, and can have a sound pressure level in the range of about 20 to 120 dB, preferably 30 to 100 dB, preferably 35 to 80 dB, preferably maximally 70 dB. Additionally, due to the changing thickness of threads 20, the torque required to disengage lid 12 from neck 14 reduces as the lid is coming closer to fully disengaged, providing the user with additional tactile feedback.

As mentioned in the background, while there are already lids and containers which include recesses and projections to produce a sound when engaging lid to container, they all require a special configuration of both the lid and the container such that the projections and recesses can interact to produce the desired sound. The current invention uses an arrangement whereby a standard container with an annular ring 22 around the neck 14 can be used as an engagement mechanism, and only the lid must be specially designed and formed to interact to provide a specific range of audible and tactile feedback desired.

The use of lid 12 with engagement mechanisms and container 10 with neck 14 with annular ring 22 provide audible sound and tactile feedback at the engaging and disengaging of lid 12 with container 10. Specifically, protrusions 18 and recess 19 in lid 12 work to provide sensorial feedback when snapping over annular ring 22 (or when coming back off). This sensorial feedback helps a user to know that lid 12 is properly engaged with container 10, thereby ensuring sealing of container 10 and freshness of contents inside. Additionally, the increase in thickness of one or more of threads 16, 20 can also help a user know and feel full engagement between lid 12 and container 10. These features work with annular ring 22, which is a common feature on standard containers 10 used for handling, particularly during manufacturing processes. Thus, lid with the engagement features allows for the inclusion of this system with a variety of standard containers and/or neck sizes, including containers which have been manufactured in a variety of different ways. Additionally, by these features providing the user audible and tactile feedback for the disengagement of lid 12 from container 10, they also provide a user assurances that the container 10 and lid 12 were fully engaged and protecting the freshness of the contents of container between uses.

The engagement of protrusions 18 with annular ring 22 also provides a securing feature, ensuring that lid 12 does not become unintentionally disengaged from neck 14 once in a fully engaged position. This can be especially useful during storage and/or transportation of containers 10, thereby ensuring freshness of any product in container 10.

The size and shape of engagement mechanisms are shown for example purposes only, and only require that they be able to engage annular ring 22 of neck 14, providing audible and tactile feedback through engagement. Additionally, the layout and number of threads for engagement of lid 12 with neck 14 are also examples, and could be a different configuration of complementary threads which may engage each other. In some embodiments, threads may be a constant width, and not cause additional torque when moving lid to a fully engaged position, with the only tactile and/or audio feedback given through engagement mechanism(s) and annular ring.

Figure 2A:
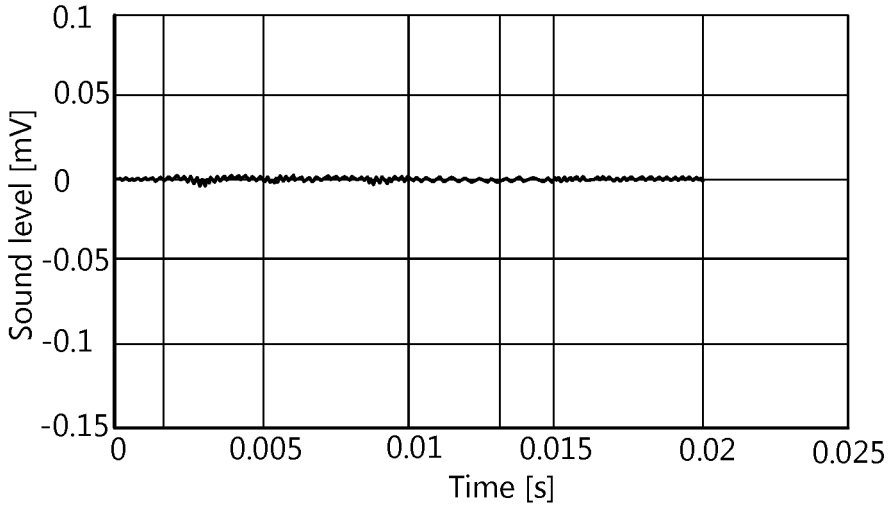
FIG. 2A shows a sound profile of an opening of a lid and container.
Figure 2B:
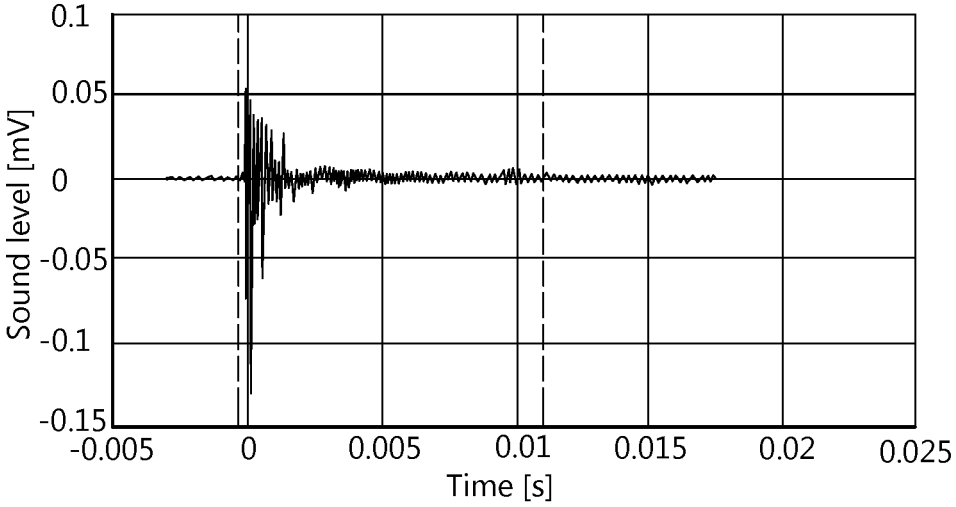
FIG. 2B shows a sound profile of a closing of a lid and container.
Figure 2C:
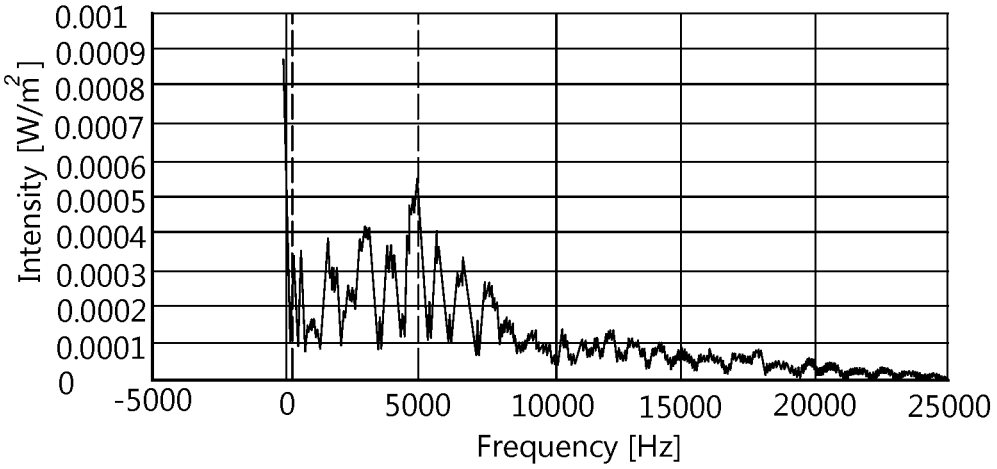
FIG. 2C shows a frequency histogram of an opening of a lid and container.
Figure 2D:
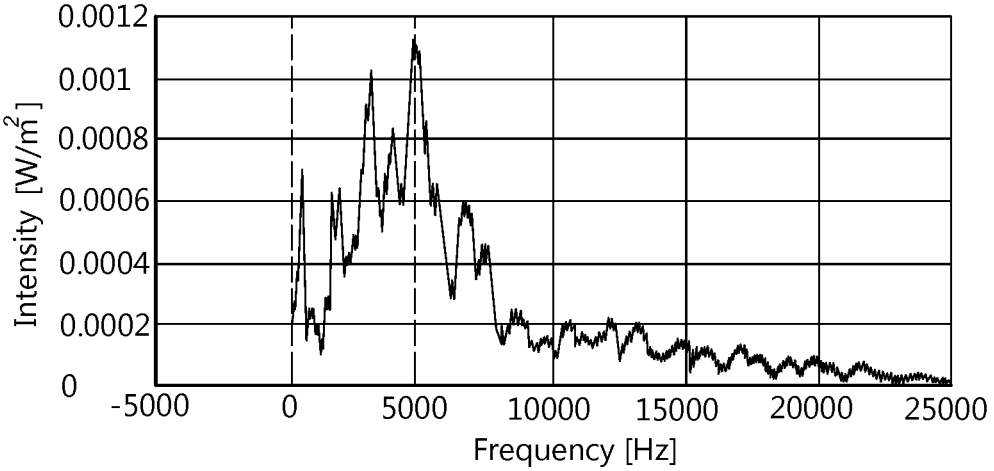
FIG. 2D shows a frequency histogram of a closing of a lid and container.

FIGS. 2A-2B show sound profiles of an opening (FIG. 2A) and closing (FIG. 2B) of a lid and container, for example the lid 12 and container 10 of FIGS. 1A-1C. The sound profile represents the volume and duration of audible sounds from the events (engagement or disengagement between a lid and container). FIGS. 2C and 2D show frequency histograms of an opening (FIG. 2C) and closing (FIG. 2D) of a lid and container, for example, the lid 12 and container 10 of FIGS. 1A-1C. These graphs show the frequency intensity within the audible range for the engagement and disengagement of a lid from a container.

The specific lid 12 and container 10 used to produce the sound profiles and frequency histograms of FIGS. 2A-2D include a container comprising polyethylene terephthalate and a lid comprising polypropylene. The container 10 volume is about 600 grams, with the neck diameter about 83 mm and the thickness at least 0.3 mm. The lid 12 has an external diameter of about 88 mm and a thickness of at least 1 mm. While these are the materials used to produce these specific sound profiles and frequency histograms, these are for example purposes only, and lids 12 and containers 10 could be formed of other materials and/or with other dimensions to produce the desired range of audible and tactile feedback.

As can be seen in FIGS. 2A and 2C, the opening of lid 12 from container 10 can result in a "subtle pop" in sound profile. The intensity preferably is in the range of about 0.00005 to 0.002 watt per square metre ($W/m^2$), preferably from about 0.00005 to 0.001 $W/m^2$, preferably from about 0.0001 to 0.0008 $W/m^2$, and then dissipates quickly, lasting only about 0.01 seconds or more but usually less than 0.025 seconds.

The closing of lid 12 with container can produce the sound profile and frequency histogram shown in FIGS. 2B and 2D, with a snap or pop sound. Preferably the frequency intensity of the snap is in the range of about 0.00005 to 0.003 watt per square metre ($W/m^2$), preferably from about 0.00005 to 0.002 $W/m^2$, preferably from about 0.0001 to 0.0016 $W/m^2$, with the audible range of about 20 to 120 dB, preferably 30 to 100 dB, preferably 35 to 80 dB, preferably maximally 70 dB, for about 0.01 seconds or more, for example, from about 0.01 seconds to 0.025 seconds.

These sound profiles and frequency histograms are a result of the specific lid and container engagement mechanisms and result in specific volumes, durations and frequency intensities which have been tested to provide a user with clear audible feedback when engaging or disengaging a lid from a container. This results in a user clearly being able to hear (as well as feel) the engagement or disengagement, providing the user with better assurances regarding sealing of the lid and container and freshness of the product within.

Some specific examples of containers 10 and lids 12 which could be used to produce desired audible and tactile feedback for a user include containers made of PET and lids formed of PP with the following dimensions:

| Container volume | Container neck diameter (mm) | Lid external diameter (mm) | Lid Thickness minimum (mm) | Container Thickness minimum (mm) |
|---|---|---|---|---|
| 200 g/8 oz | 58.56 | 63 | 1 | 0.5 |
| 250 g | 58.56 | 63 | 1 | 0.5 |
| 395 g | 73.56 | 78 | 1 | 0.3 |
| 400 g/15 oz | 73.56 | 78 | 1 | 0.3 |
| 500 g | 73.56 | 78 | 1 | 0.3 |
| 600 g | 83 | 88 | 1 | 0.3 |
| 800 gr/30 oz | 90 | 95 | 1.2 | 0.5 |
| 36 oz | 90 | 95 | 1.2 | 0.5 |
| 48 oz | 102 | 107 | 1.2 | 0.5 |
| 64 oz | 115 | 120 | 1.2 | 0.5 |

While these specific examples are given, other containers and lids could produce the desired audible and tactile feedback, and this application is not limited to the specific example dimensions given above.

The sound levels referenced for the audible feedback are generally from a distance of about 0.5 meters, or an arm's length.

While the invention has been described with reference to exemplary embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiments disclosed, but that the invention will include all embodiments falling within the scope of the appended claims.

The invention claimed is:

1. A container (10) with a lid (12) for food products comprising:

a body with a neck (14) surrounding an opening;

at least one thread (20) on the neck (14);

an annular ring (22) on the neck (14) beneath the at least one thread (20);

at least one thread (16) on the lid (12) for engaging the at least one thread (20) on the neck (14); and an engagement mechanism (18) on the lid (12) to engage the annular ring (22) and secure the lid (12) to the neck (14) when the lid is in a fully engaged position, wherein audible and tactile feedback is produced when the lid (12) moves into the fully engaged position, wherein the container comprises polyethylene terephthalate and the lid comprising polypropylene, wherein a subtle pop lasting at least 0.01 seconds is generated upon disengaging the lid (12) from the neck (14), and maximally 0.025 seconds, and wherein the subtle pop has a sound pressure level in the range of about 20 to 120 dB, and wherein full engagement of the lid (12) with the neck (14) produces a snap sound, wherein the snap sound lasts at least 0.01 seconds, and maximally 0.025 seconds and wherein the sound pressure level of the snap is in the range of 20 to 120 dB, wherein the engagement mechanism comprises a plurality of extended protrusions (18) at a lower portion of the lid positioned to snap over the annular ring (22) when the lid (12) moves into the fully engaged position.

2. The container with a lid of claim 1, wherein the plurality of extended protrusions comprises a plurality of protrusions similar in length and circumferentially aligned at a lower portion of the lid (12) with an interruption between adjacent protrusions circumferentially around the lid.

3. The container with a lid of claim 1, wherein the lid further comprises a recess (19) to receive the annular ring (22).

4. The container with a lid of claim 1, wherein the audible and/or tactile feedback is generated by the engagement mechanism (18) moving over the annular ring (22) to engage the lid (12) with or disengage the lid (12) from the neck (14).

5. The container with a lid of claim 1, wherein the at least one thread (20) on the neck (14) and/or the at least one thread (16) on the lid (12) are varied in thickness such that progressive torque is required to bring the lid (12) into the fully engaged position.

6. A method of forming a lid (12) for engagement with a container (10) for food products with at least one thread (20) and an annular ring (22) for food products, the method comprising:

forming a lid (12) comprising polypropylene with at least one thread (16); and forming an engagement mechanism (18) comprising a plurality of extended protrusions (18) at a lower portion of an inner surface of the lid positioned to snap over the annular ring (22) when the lid (12) moves into the fully engaged position, and positioned such that audible and tactile feedback are produced from the engagement of the engagement mechanism (18) and the annular ring (22) when the lid (12) has moved into a fully engaged position with the container (10) comprising polyethylene terephthalate, wherein a subtle pop lasting at least 0.01 seconds is generated upon disengaging the lid (12) from the neck (14), and maximally 0.025 seconds, and wherein the subtle pop has a sound pressure level in the range of about 20 to 120 dB, and wherein full engagement of the lid (12) with the neck (14) produces a snap sound, wherein the snap sound lasts at least 0.01 seconds, and maximally 0.025 seconds and wherein the sound pressure level of the snap is in the range of 20 to 120 dB.

7. The method of claim 6, wherein the step of forming an engagement mechanism (18) on a lower portion of an inner surface of the lid (12) comprises: forming a plurality of protrusions circumferentially aligned around a lower portion of an inner surface of the lid.

8. The method of claim 6, wherein the step of forming an engagement mechanism on a lower portion of an inner surface of the lid (12) comprises:

forming a recess (19) for receiving the annular ring (22) when the lid (12) moves into a fully engaged position with the container (10).

* * * * *